US007048166B2

(12) United States Patent
Pfister et al.

(10) Patent No.: US 7,048,166 B2
(45) Date of Patent: May 23, 2006

(54) COMBUSTION POWER-OPERATED SETTING TOOL

(75) Inventors: Norbert Pfister, Montlingern (CH); Gebhard Gantner, Nenzing (AT)

(73) Assignee: Hilti Aktiengesellschaft, Schaan (LI)

( * ) Notice: Subject to any disclaimer, the term of this patent is extended or adjusted under 35 U.S.C. 154(b) by 21 days.

(21) Appl. No.: 11/018,475

(22) Filed: Dec. 21, 2004

(65) Prior Publication Data

US 2005/0189391 A1 Sep. 1, 2005

(30) Foreign Application Priority Data

Dec. 22, 2003 (DE) ..... 103 60 371

(51) Int. Cl.
*B25C 1/14* (2006.01)

(52) U.S. Cl. ..... 227/9; 227/10; 89/1.14

(58) Field of Classification Search ..... 227/9, 227/10, 11, 130; 123/46 SC; 89/1.14
See application file for complete search history.

(56) References Cited

U.S. PATENT DOCUMENTS 3,565,313 A * 2/1971 Hans-Dieter Seghezzi et al. ..... 227/10
3,632,032 A * 1/1972 Termet ..... 227/10
4,114,792 A * 9/1978 Pomeroy ..... 227/8
4,804,127 A * 2/1989 Kirkman ..... 227/10
5,251,532 A * 10/1993 Frommelt et al. ..... 89/1.14
5,363,736 A * 11/1994 Huang ..... 89/1.14
5,767,434 A * 6/1998 Hirtl et al. ..... 89/1.14
5,829,661 A * 11/1998 Hirtl et al. ..... 227/10
6,272,782 B1 * 8/2001 Dittrich et al. ..... 42/6
6,378,752 B1 * 4/2002 Gaudron ..... 227/10
6,547,120 B1 * 4/2003 Popovich et al. ..... 227/10
6,712,255 B1 * 3/2004 Dittrich et al. ..... 227/10

* cited by examiner

*Primary Examiner*—Scott A. Smith
(74) *Attorney, Agent, or Firm*—Abelman, Frayne & Schwab

(57) ABSTRACT

An explosive powder charge-operated setting tool for driving fastening elements in a constructional component includes a propellant-driven setting mechanism, an ignition element (23) for igniting a propellant (71) received in the propellant receptacle (18) of the setting mechanism, and a transporting device (30) for displacing a propellant magazine in a guide channel (22) and including elements operable by the ignition element (23) for displacing the transporting device from a first position in which the transportation of propellants is prevented, into a second position in which at least partial transportation of the propellants is possible.

11 Claims, 9 Drawing Sheets

Fig. 5
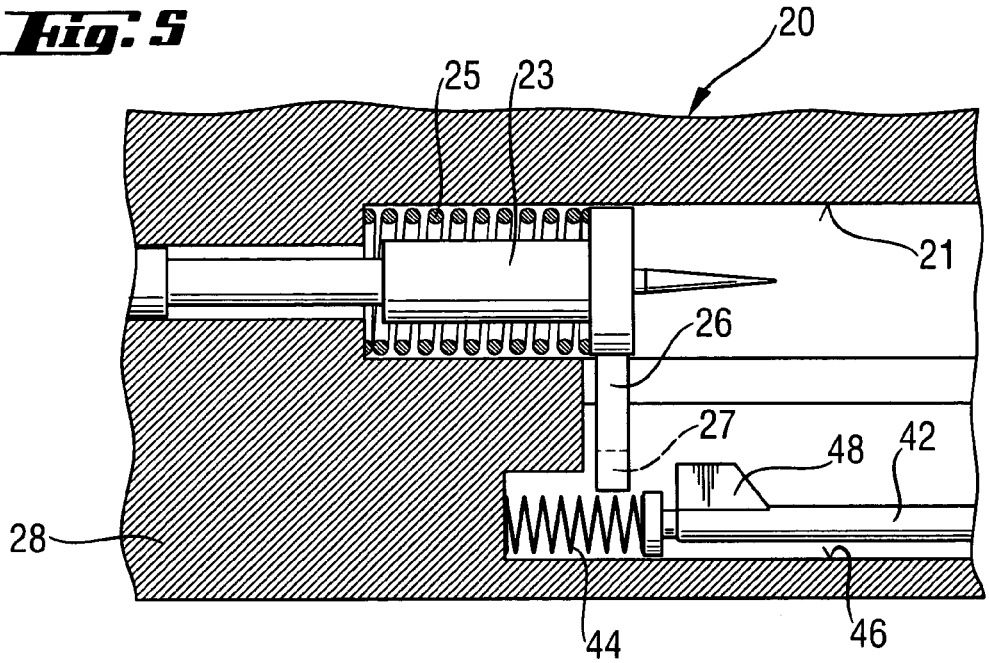
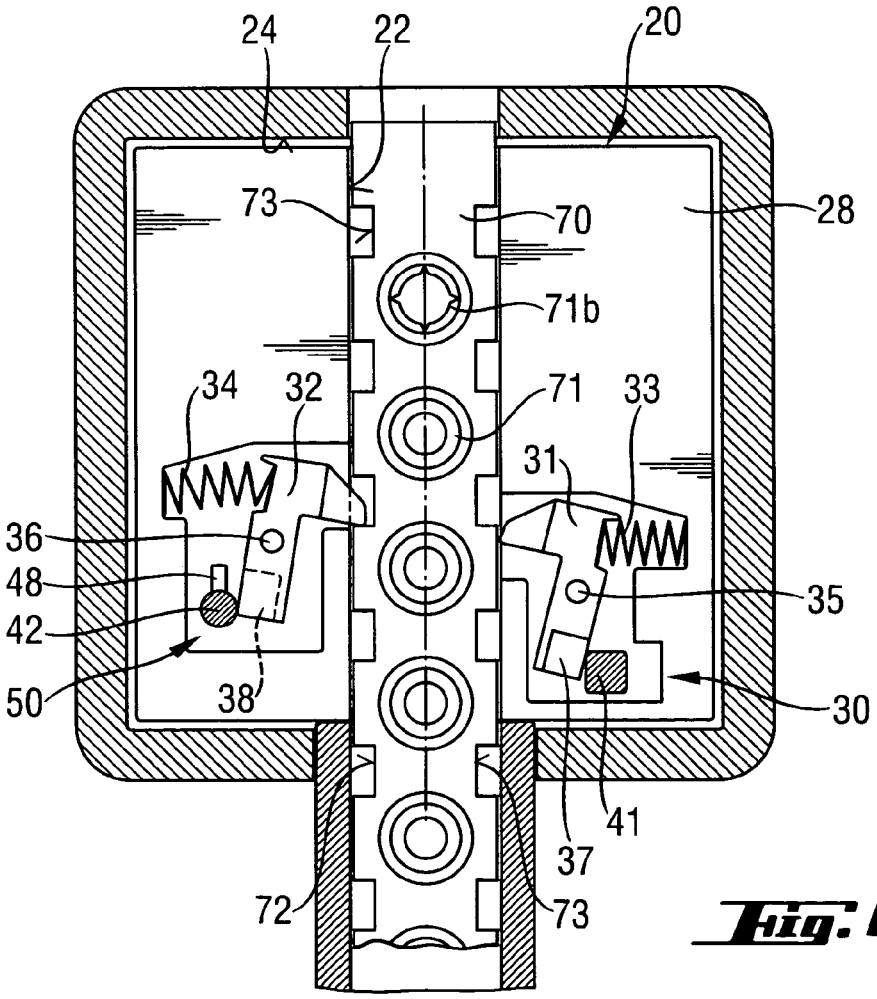
Fig. 6

COMBUSTION POWER-OPERATED SETTING TOOL

BACKGROUND OF THE INVENTION

1. Field of Invention

The present invention relates to a combustion power-operated setting tool such as an explosive powder charge-operated setting tool for driving fastening elements in a constructional component and including a propellant-driven setting mechanism including a propellant receptacle for receiving a propellant, ignition means for igniting the propellant received in the propellant receptacle, a guide channel for receiving a propellant magazine, and a transporting device for displacing the propellant magazine in the guide channel.

2. Description of the Prior Art

The setting tools of a type described above operate, mostly, with solid fuels in form of cartridges filled with the explosive powder or in form of pellets made of compressed explosive powder. The setting mechanism of these setting tools includes a piston guide which is at least partially arranged in the tool housing, and a setting piston axially displaceable in the piston guide. The setting piston of these setting tools is driven by combustion gases of the fuel. The setting piston drives fastening elements, such as nails, bolts, etc. in the constructional components. After completion of a setting process, the setting piston should be returned to its initial position. The propellants are fed to the propellant receptacle in the setting tool, e.g., in form of a magazine strip. As a rule, after completion of a setting process, the magazine strip, which is displaced in a guide channel, is displaced by a transporting mechanism by one cartridge.

German Publication DE 30 359 28 A1 discloses a combustion power-operated setting tool in which the cartridges are displaced by a mechanism that is actuated upon the setting tool being pressed against a constructional component. The transportation of the cartridges, however, is blocked if the setting tool, upon having been pressed against a constructional component, is not actuated. The blocking can, however, be released upon actuation of overriding means, e.g., in order to unload the setting tool. The transporting mechanism includes a transporting slide that is arranged on the displaceable in the housing piston guide in the region of the cartridge socket. The transporting slide is connected by a lever with a transporting pawl that engages the magazine strip.

The drawback of the known setting tool consists in that the cartridge, which is located in the cartridge socket, is transported further even when the cartridge is not ignited after actuation of the setting tool. A new actuation attempt with the same cartridge is not possible.

Accordingly, an object of the present invention is to provide a setting tool in which the drawback of the known combustion power-operated setting tool is eliminated.

Another object of the present invention is to provide a setting tool in which a reliable transportation of cartridges during a setting process is insured.

SUMMARY OF THE INVENTION

These and other objects of the present invention, which will become apparent hereinafter, are achieved by providing a setting tool of the type described above and the transporting device of which includes means operable by the ignition means for displacing the transporting device from a first position in which the transportation of propellants is prevented, into a second position in which at least partial transportation of the propellants is possible. For operating the displacing means, an ignition displacement of the ignition means, e.g., of a firing pin is used when it is advanced toward a propellant located in the propellant receptacle. This insures that a non-consumed propellant can only then be completely transported up to the propellant receptacle or be at least partially transported toward the propellant receptacle when the ignition means actually strikes, after actuation of the setting tool, the propellant in the propellant receptacle. In case when the ignition means is not displaced, the transportation device is not released so that the same propellant would be enclosed in the propellant receptacle when the setting tool is pressed against a constructional component anew. A non-consumed propellant would not be automatically transported.

Advantageously, the transporting device includes transporting spring means for biasing the propellant magazine, e.g., a propellant strip or a cartridge strip, which is received in the guide channel, in a transporting direction. The spring means provides for a technically simple displacement of the propellant magazine.

It is further advantageous when the transporting device displacing means includes at least one locking member and a spring for biasing the at least one locking member in a direction toward the guide channel into a position in which transportation of the propellant is blocked. The locking member fixes the magazine or the propellant strip in its position in the guide channel until the locking member is actuated. Advantageously, the locking member cooperates with recesses provided on a side of the propellant strip. The side recesses permit to control in a simple manner the displacement of the propellant strip by the transporting spring means.

Advantageously, the transporting device includes at least one actuator for displacing the at least one locking member against a spring-biasing force of the biasing spring from the position in which the transportation of the propellants is blocked, into a position in which the transportation of the propellants becomes possible. Thus, the actuator controls the operation of the locking member.

Advantageously, the at least one actuator is displaced by the ignition means from a release position in which displacement of the at least one locking member by the actuator is prevented, into an actuation position in which the displacement of the at least one locking member by the actuator becomes possible. If a further actuator is provided, it can be controlled exclusively by the press-on mechanism of the setting tool. In this way, the transporting device can be controlled or at least partially controlled in a simple manner. It can further be advantageous to provide the ignition means with a control element for displacing the at least one actuator from its release position into its actuation position upon displacement of the ignition means after actuation of the setting tool, from an ignition-ready position of the ignition means into its ignition position.

Advantageously, the transporting device displacing means includes two locking members axially offset relative to each other and arranged on opposite sides of the guide channel. With two locking members, the transportation path of the transporting device can be divided in two parts or sections.

For effecting a complete transporting sequence for displacing a new propellant in a position coaxial with the propellant receptacle and, optionally for a complete transporting sequence for displacing a burnt-up propellant out of a position coaxial with the propellant receptacle, actuation of both locking members one after another is necessary.

Advantageously, the locking members are formed as pawls pivotally supported on respective pivot supports. This permits to reduce the actuation force and the actuation path of the actuators.

It is further advantageous when the pivot supports are secured to the guide housing for the ignition means. This permits to obtain a compact structure.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment when read with reference to the accompanying drawings.

BRIEF DESCRIPTION OF THE DRAWINGS

The drawings show:

FIG. 5 a longitudinal cross-sectional view of a section of the setting tool showing a detailed view of the ignition unit;

FIG. 6 a cross-sectional view of the setting tool according to FIG. 2 in a completely pressed-on condition;

DETAILED DESCRIPTION OF THE PREFERRED EMBODIMENTS

Figure 1:
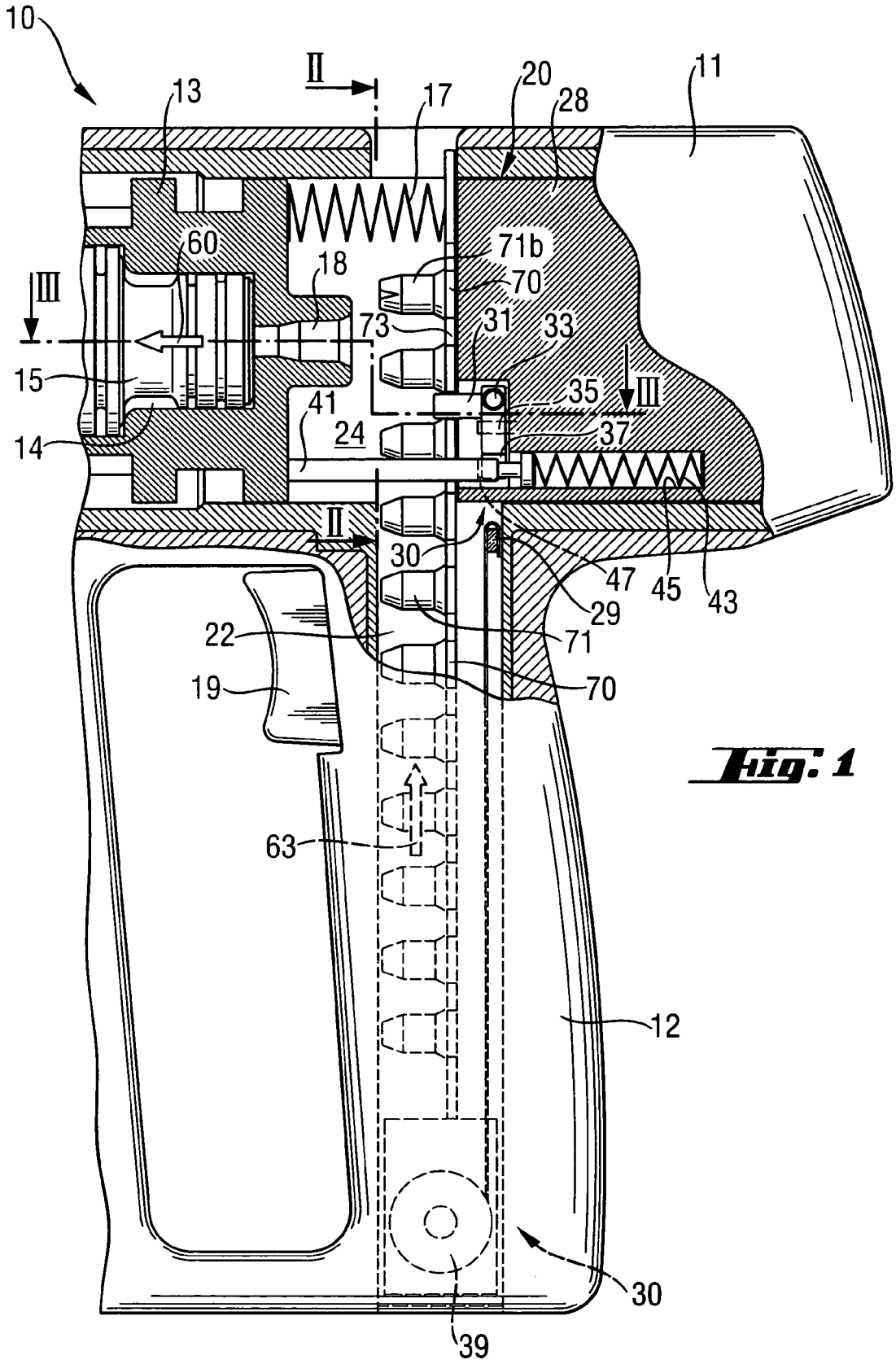
FIG. 1 a partially cross-sectional view of a section of a combustion power-operated setting tool according to the present invention in an initial position of the setting tool.

A combustion power-operated setting tool 10 according to the present invention, which is shown in FIGS. 1 through 10, includes a one-or multi-part housing 11, and a piston guide 13 which is displaceably arranged in a receiving chamber 24 of the housing 11 and is supported in the housing 11 by a spring 17 that biases the piston guide 13 in a setting direction. A setting piston 15 is axially displaceably arranged in a guide chamber 14 of the piston guide 15. In the piston guide 13, there is provided a propellant receptacle 18 which is formed as a cartridge socket for receiving propellants 71, e.g., cartridges with which the setting piston 15 is driven. An ignition unit 20 serves for ignition of a propellant 71 that is received in the propellant 71 that is received in the propellant receptacle 18 (see, in particular, FIG. 1). As particular shown in FIG. 5, the ignition unit 20 includes ignition means 23 which is displaceable in a firing pin guide 21 and which is formed as a firing pin. The ignition means 23 is biased in the ignition direction by a spring 25.

On the housing 11, there is provided, in the embodiment shown in the drawings, a handle 12 that carries an actuation switch 19 for actuating the ignition unit 20 and thereby the setting process. The actuation switch 19 is actuated by a user of the setting tool 10.

Figure 2:
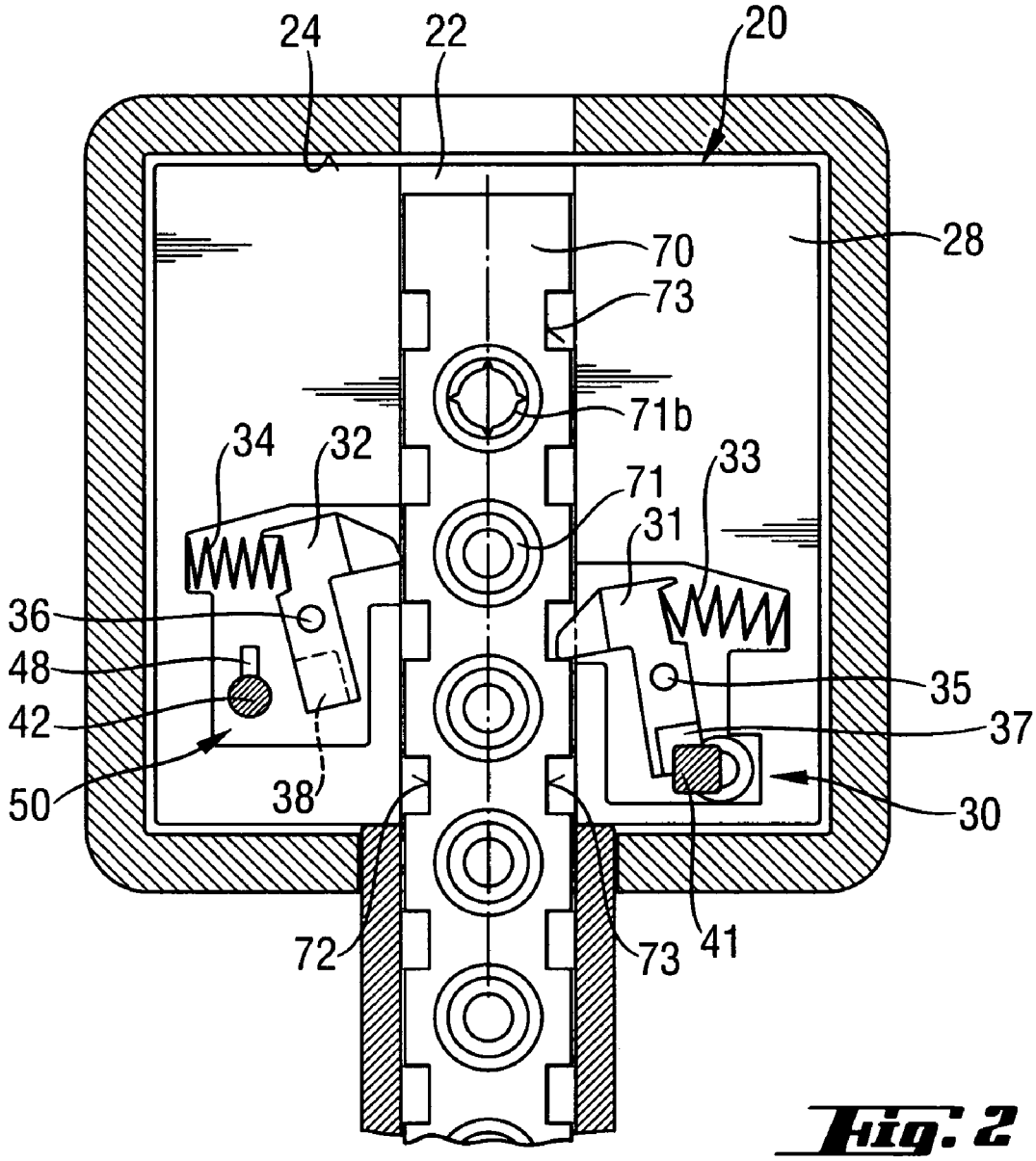
FIG. 2 a cross-sectional view of the setting tool along line II—II in FIG. 1.
Figure 3:
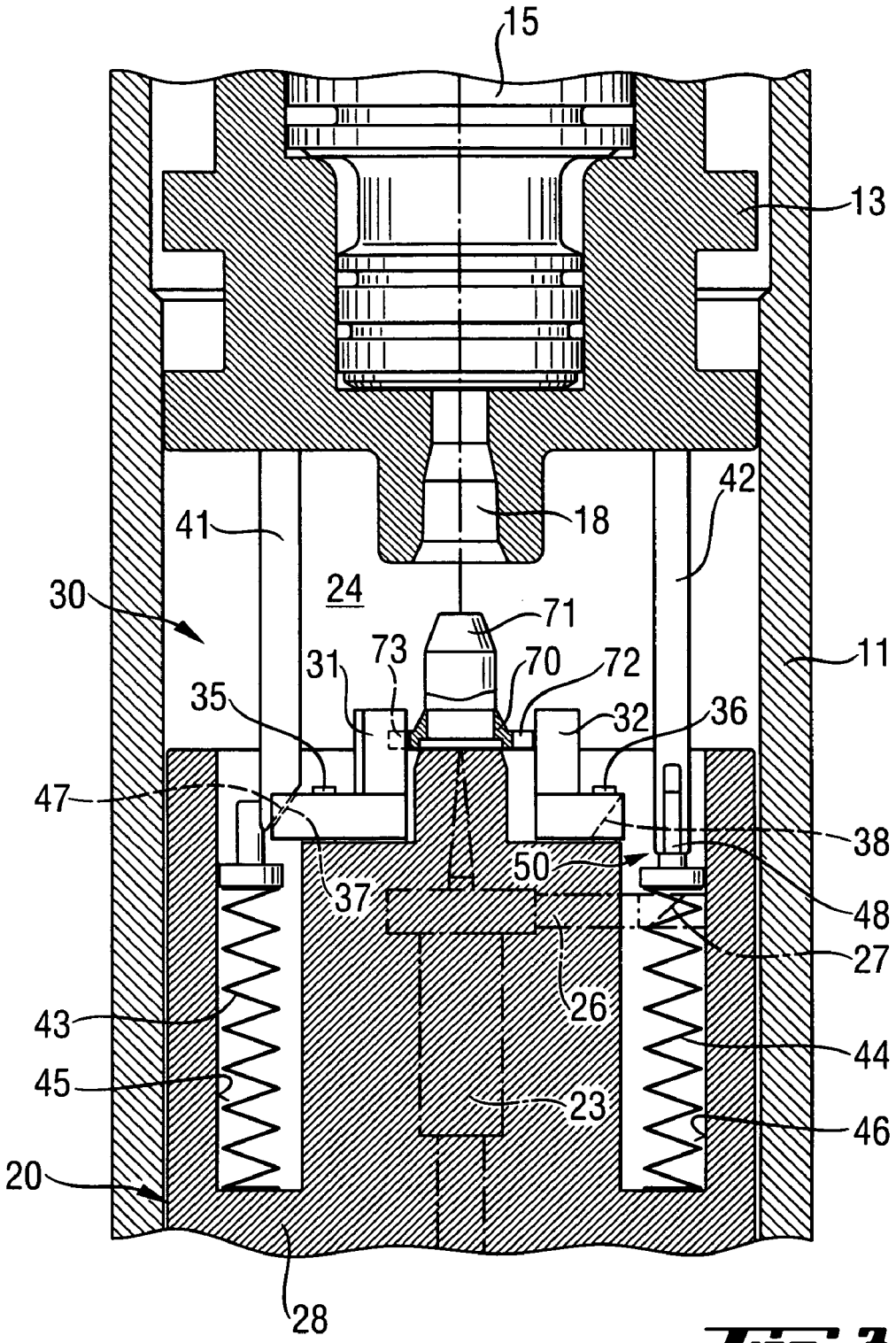
FIG. 3 a cross-sectional view of the setting tool along line III—III in FIG. 1.

Cartridges with propellants 71 are stored in a propellant magazine which is formed as a propellant strip 70 displaceable in a guide channel 22 by a transporting device 30. The transporting device 30 has a transporting spring element 39 which is formed as a scroll spring having its free end secured at a point 29 to the housing 11 in the region adjacent to the ignition unit 20 and the receiving chamber 24. Upon displacement the propellant strip 70 in the guide channel 22 in a direction opposite the transporting direction 63, the transporting spring element 39 becomes tensioned and biases the propellant strip 70 in the transporting direction 63. The transporting device 30 further includes two opposite, offset relative to each other locking members 31, 32 arranged on opposite sides of the guide channel 22 and formed as pawls. The locking members 31, 32 are pivotally arranged on respective pivot support 35, 36 provided in a guide housing 28 of the ignition unit 20. Two springs 33, 34 bias the respective locking members 31, 32 toward the guide channel 22, as particularly shown in FIGS. 2, 6, and 9. In the initial position of the setting tool 10, which is shown in FIGS. 1–3, the locking member 31 engages in a side recess 73 of the propellant strip 70, whereas the second locking member 32 engages an elevation between two recesses 72 provided on opposite side of the propellant strip 70. Both locking members 31, 32, thus, project into the guide channel 22 (see, in particular, FIGS. 2–3). Both locking members 31, 32 have each an actuation section 37, 38 formed as inclination surface means. The actuation sections 37, 38 cooperate with respective adjusting sections 47, 48 of respective actuators 41 and 42.

The first actuator 41, which is formed as a pin, is arranged on the same side of the setting tool as the locking member 31 and is secured on the piston guide 13. The adjusting section 47, which is formed as an inclination surface, is provided at a free end of the actuator 41 and is spaced, in the initial position of the setting tool 10 shown in FIGS. 1–3, from the actuation section 37 of the respective locking member 31. The actuator 41 is displaceably arranged in a guide 45 provided in the guide housing 28 of the ignition unit 20. The actuator 41 is displaceable against a biasing force of a spring 43.

The second actuator 42, which is also formed as a pin, is arranged on the same side of the setting tool 10 as the locking member 32. The actuator 42 is displaceably arranged in a guide 46 provided in the guide housing 28 of the ignition unit 20, and is displaceable against a biasing force of a spring 44. The adjusting section 48 of the actuator 42 is formed as a blade-shaped projection. In the initial position shown in FIGS. 2–3, the actuator 42, together with its adjusting section 48, is located in its release position 50 in which the adjusting section 48 is pivoted out from the axial projection of the actuation section 38 of the locking member 32. An actuation of the locking member 32, with the adjusting section 48 of the actuator 42 acting on the actuation section 38, is not possible in the position 50 of the actuator 42.

On the ignition means 23, there is provided a control element 26 having a control section 27. Upon displacement of the ignition means 23 toward the propellant receptacle 18 in the setting direction 60, the control section 27 displaces the actuator 42, together with its adjusting section 48, in a manner of a link control, from its release position 50 in its actuation position 51 in which the adjusting section 48 is pivoted into the axial projection of the actuation section 38 of the locking member 32, as will be explained in more detail further below.

Figure 4:
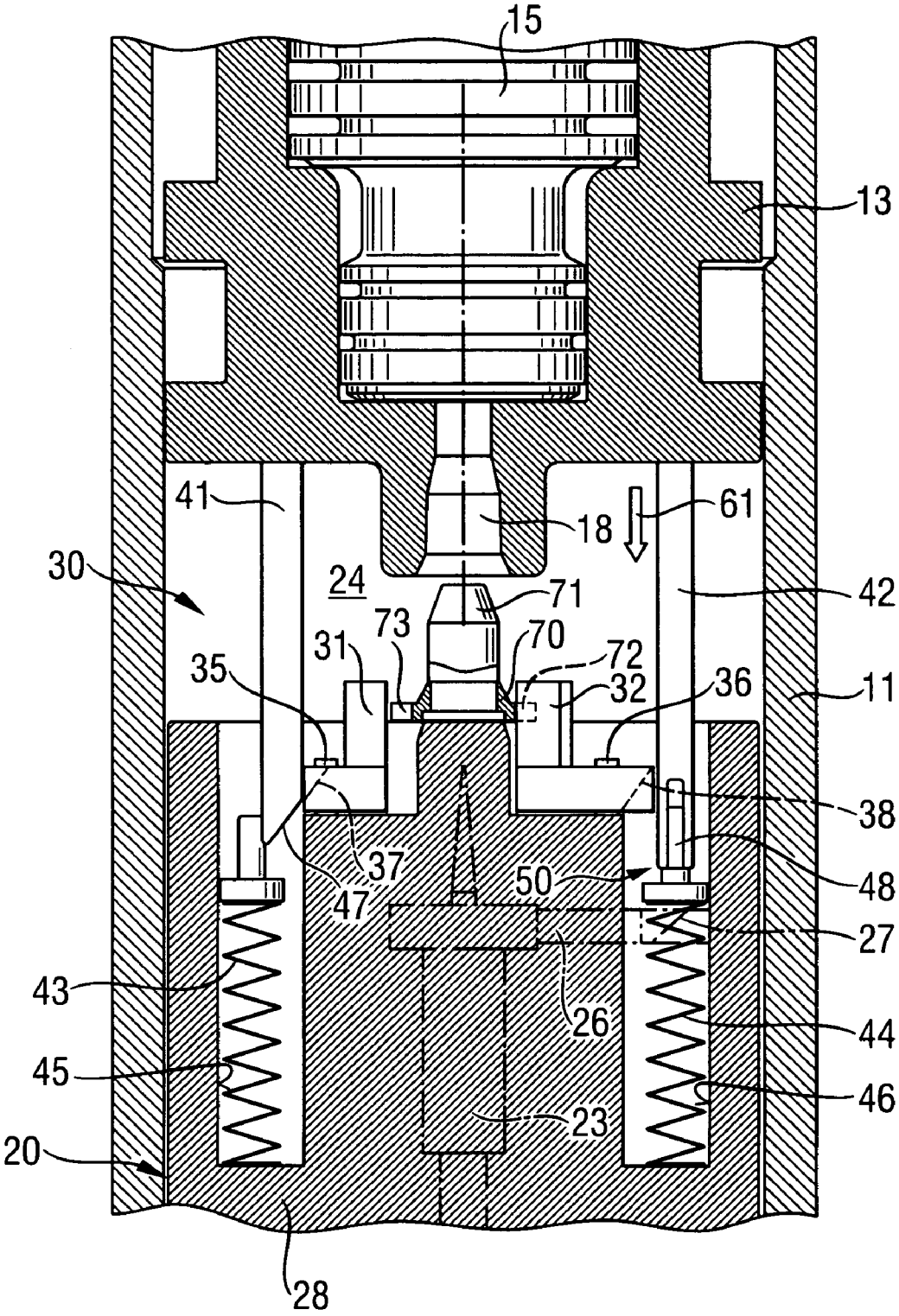
FIG. 4 a cross-sectional view of the setting tool according to FIG. 3 in a partially pressed-on condition.

FIG. 4 show the setting tool 10 in a condition in which it is partially pressed with its mouth portion against a constructional component (not shown). In this position of the setting tool 10, the piston guide 13, together with the actuator 41, is displaced in a direction 61 opposite the setting direction toward the ignition unit 20. The adjusting section 47 of the actuator 41 acts on, applies pressure to the actuation section 37 of the locking member 31, lifting it, against the biasing force of the spring 33 (not shown in FIG. 4, see FIG. 2), off its locking position in the recess 73 of the propellant strip 70.

As a result, the propellant strip 70 is displaced in the transporting direction 63 by the transporting spring 39 (see FIG. 1) until the locking member 32 engages, under the biasing force of the spring 34, in the next recess 72 of the propellant strip 70 (see FIG. 4). Now, the propellant strip 70 is located in a position in which a new propellant 71 is arranged coaxially with the propellant receptacle 18.

With the setting tool 10 being further pressed against the constructional component, an actuator (not shown), which is provided on the piston guide 13 preloads the ignition means 23, displacing it into its ignition position, as shown in FIG. 5.

Figure 7:
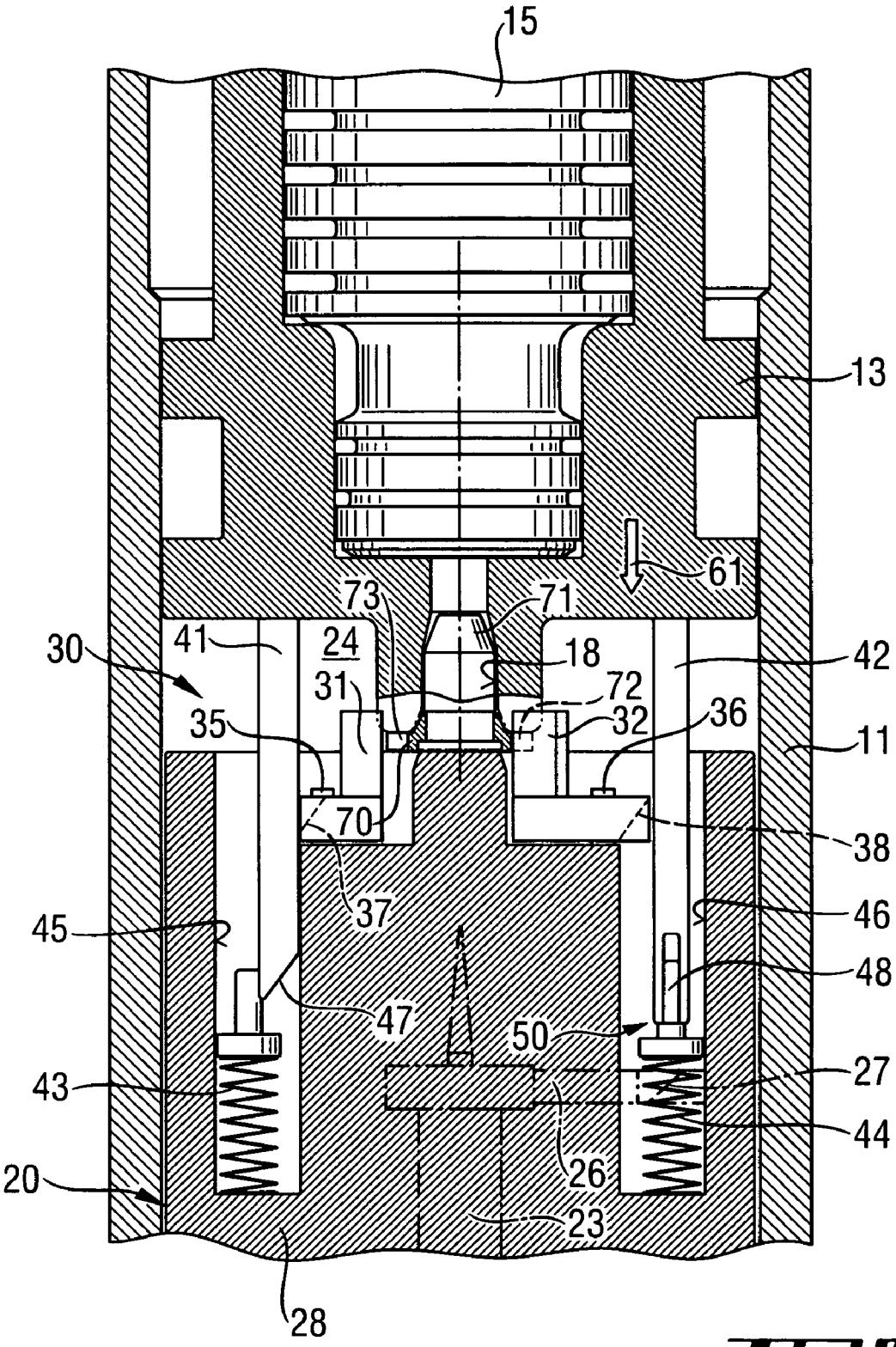
FIG. 7 a cross-sectional view of the setting tool according to FIG. 3 in a completely pressed-on condition.

FIGS. 6–7 show the setting tool 10 in a position in which it is completely pressed against the constructional component. As a result of further displacement of the piston guide 13 in the direction 61, the propellant 71 is pushed into the propellant receptacle 18, becoming enclosed herein, as particularly shown in FIG. 7. The locking member 31 still remains in its lifted off position in which it is held by the actuator 41. The second locking member 32 meanwhile engages in the recess 72. The actuator 42, together with its adjusting section 48, remains in its release position 50, and the transporting device 30 remains, thus, in a position in which transportation of propellants is prevented.

Figure 8:
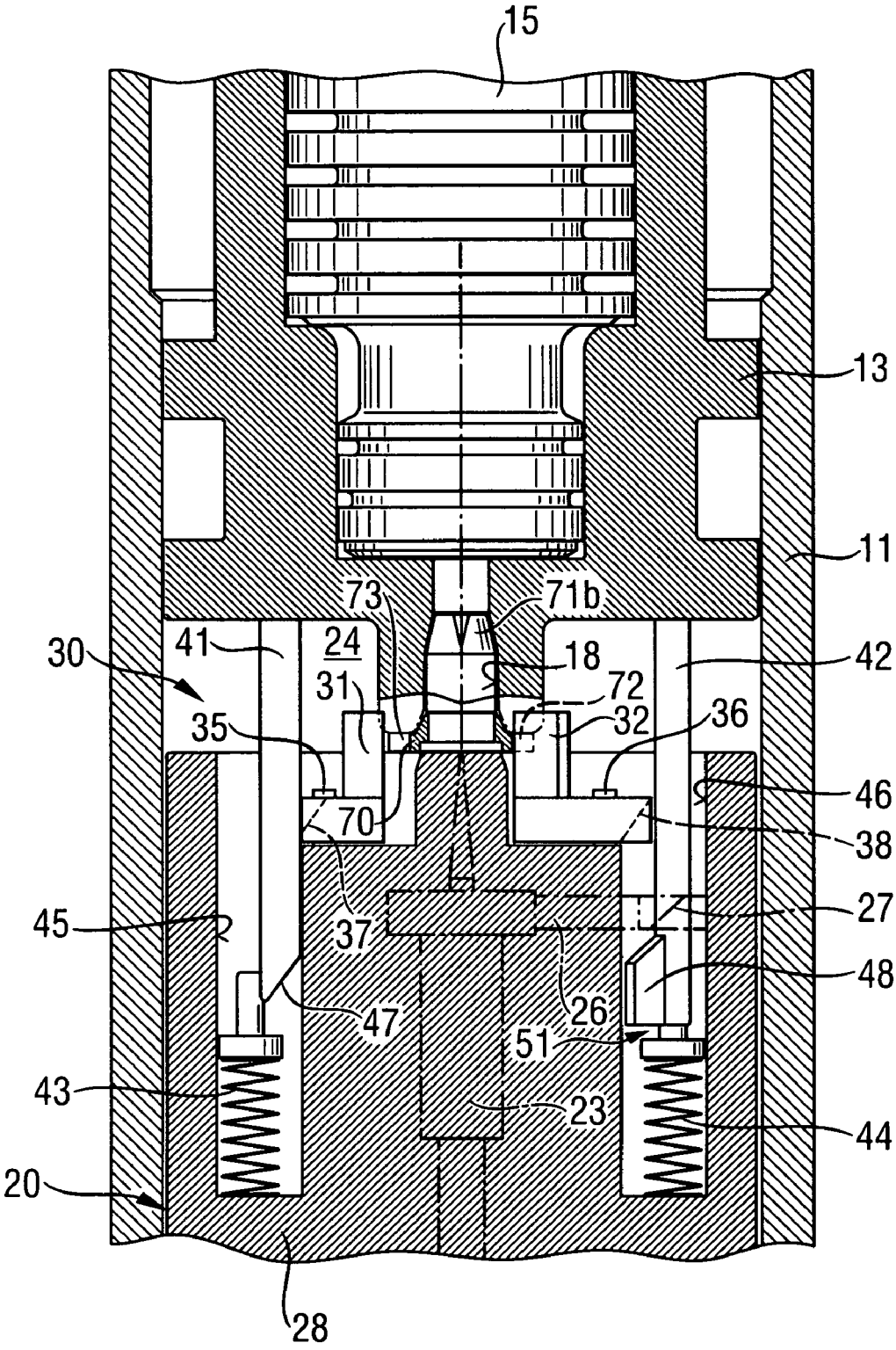
FIG. 8 a cross-sectional view of the setting tool according to FIG. 3 in a release condition.

FIG. 8 shows the setting tool 10 in a position in which the ignition has taken place, as shown by a burnt-up propellant 71*b*. To this end, upon actuation of the actuation switch 19 (see FIG. 1), the ignition means 23 strikes the propellant 71, igniting the same, upon being displaced by the biasing force of the spring 25 (see FIG. 5). With this, the control section 27 of the control element 26 engages the adjusting section 48 of the actuator 42, displacing the actuator 42 in its actuation position 51, shown in FIGS. 8–10, and in which the adjusting section 48 lies in the axial projection of the actuation section 38 of the locking member 32. The position of the first locking member 31 remains unchanged.

Figure 9:
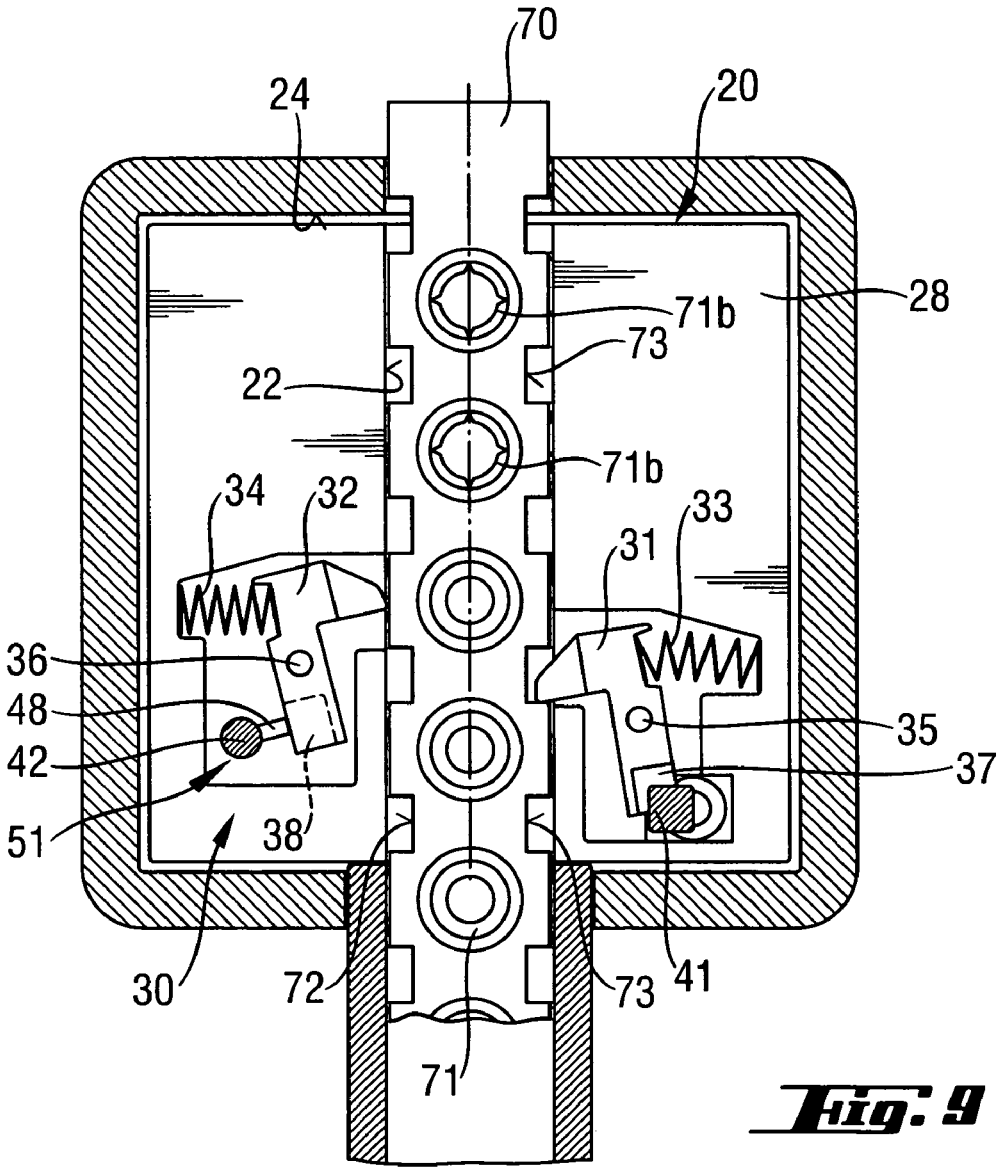
FIG. 9 a cross-sectional view of the setting tool according to FIG. 2 in its partially lifted-off condition.
Figure 10:
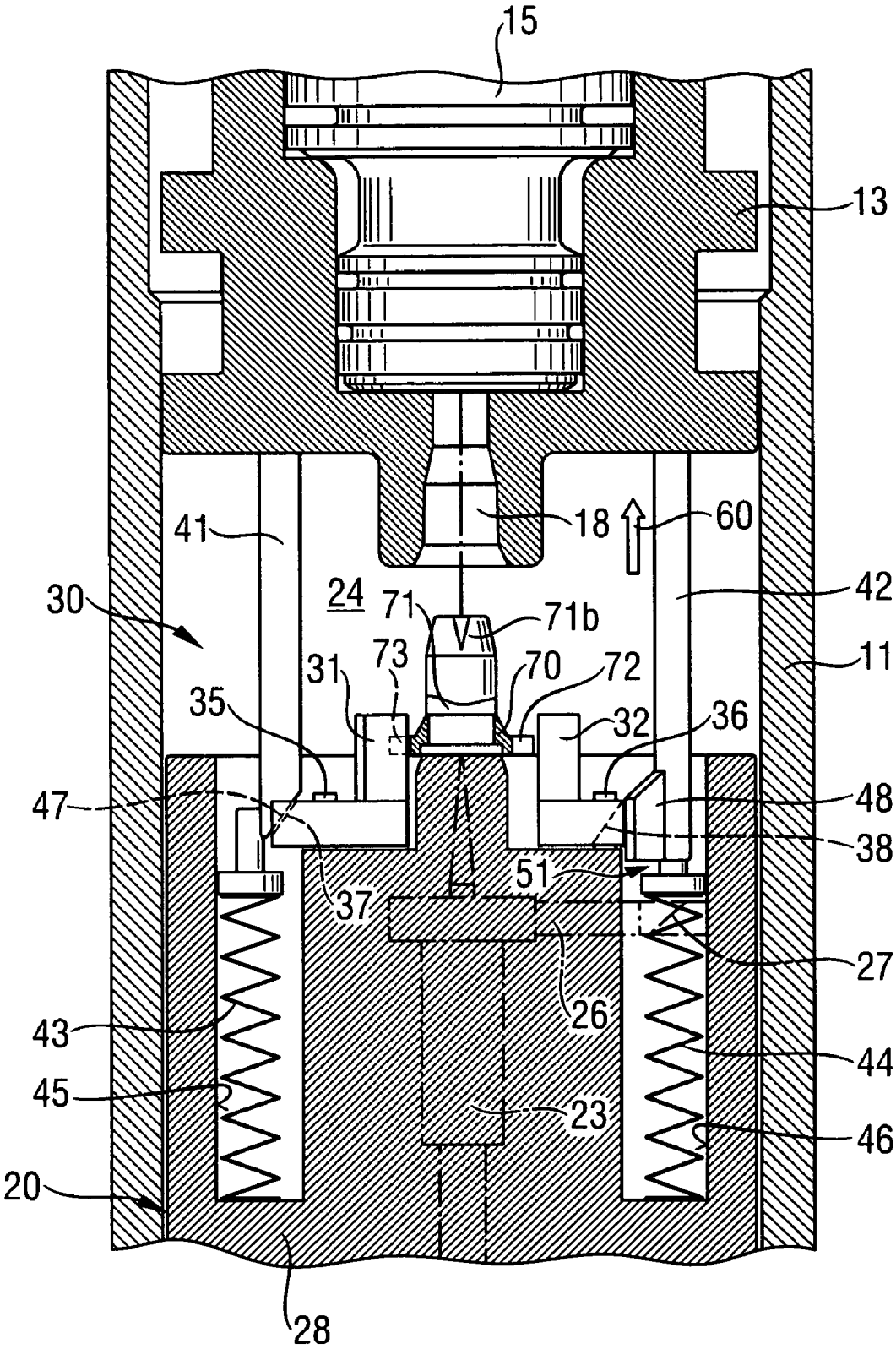
FIG. 10 a cross-sectional view of the setting tool according to FIG. 3 in its partially lifted-off condition.

FIGS. 9–10 show the setting tool 10 in a condition in which it is almost completely lifted off the constructional component. In this position of the setting tool 10, the piston guide 13 and the actuator 41, 42 are displaced in the setting direction 60 away from the ignition unit 20. As a result, the actuator 41 releases the locking member 31, which is pivoted by the spring 34 in the guide channel 22 in the direction toward the propellant strip 70 and which engages an elevation between two recesses 73 in the propellant strip 70. Immediately thereafter, the adjusting section 48 of the actuator 42 acts on the actuation section 38 of the locking member 32, pivoting the locking member 32 out of the recess 72. In this position of the transporting device 30, the propellant strip 70 is transported by the transporting spring 39 (see FIG. 1) further forward until the locking member 31 engages in the next recess 73. The propellant strip 70 occupies an intermediate position, shown in FIGS. 9–10, in which enclosure of the next, non-burnt-up propellant 71 in the propellant receptacle 18 is not possible as the propellant 71 is not coaxially aligned with the propellant receptacle 18.

Upon a complete lifting of the setting tool 10 of the constructional component, the actuator 42 is displaced, with link control means, not shown, from its actuation position 51 in its release position 50 in FIG. 2, and the setting tool 10 is returned into its initial position. Actuation of the locking member 32 is not possible without a new actuation of the ignition means 23.

In the inventive setting tool 10, transportation of the propellants is reliably prevented even when the actuation switch 19 is actuated but the ignition means 23 or the fire pin does not strike the propellant 71. The actuator 42 is not displaced, at that, in its actuation position, and the locking member 32 is not lifted off the respective recess 72, even upon the setting tool being again lifted off the constructional component.

Further, the inventive setting tool can be provided with a simple detection device that would prevent a press-on process when the presence of a fastening element in the bolt guide of in the magazine of fastening elements is not detected. In this case, the actuator 41 would not lift the locking member 31 off the recess 73 in the propellant strip 70, and the propellant strip cannot be displaced further.

The setting tool according to the present invention can further be provided with means for manual lifting of the locking members 31, 32 off the guide channel, so that the propellant strip 70, which is located in the guide channel 22, can be removed from the tool even when the strip is not completely spent.

Though the present invention was shown and described with reference to the preferred embodiment, such is merely illustrative of the present invention and is not to be construed as a limitation thereof and various modification of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. An explosive powder charge-operated setting tool for driving fastening elements in a constructional component, comprising a propellant-driven setting mechanism including a propellant receptacle (18) for receiving a propellant (71); ignition means (23) for igniting the propellant (71) received in the propellant receptacle (18); a guide channel (22) for receiving a propellant magazine; and a transporting device (30) for displacing the propellant magazine in the guide channel (22) and including means operable by the ignition means (23) for displacing the transporting device from a first position in which the transportation of propellants is prevented, into a second position in which at least partial transportation of the propellants is possible.

2. A setting tool according to claim 1, wherein the transporting device (30) includes transporting spring means (39) for biasing the propellant magazine, which is received in the guide channel (22) in a transporting direction (63).

3. A setting tool according to claim 1, wherein the transporting device displacing means comprises at least one locking member (31, 32); and a spring (33, 34) for biasing the at least one locking member (31, 32) in a direction toward the guide channel into a position in which transportation of the propellant is blocked.

4. A setting tool according to claim 3, wherein the transporting device (30) includes at least one actuator (41,

42) for displacing the at least one locking member (31, 32) against a spring-biasing force of the biasing spring (33, 34) from the position in which the transportation of the propellants is blocked, into a position in which the transportation of the propellants becomes possible.

5. A setting tool according to claim 4, wherein the at least one actuator (42) is displaced by the ignition means (23) from a release position (50) in which displacement of the at least one locking member (32) by the actuator (42) is prevented, into an actuation position (51) in which the displacement of the at least one locking member (32) by the actuator (42) becomes possible.

6. A setting tool according to claim 5, wherein the ignition means (23) comprises a control element (26) for displacing the at least one actuator (42) from the release position (50) thereof into the actuation position (51) thereof upon displacement of the ignition means (23), after actuation of the setting tool (10), from an ignition-ready position of the ignition means (23) into an ignition position thereof.

7. A setting tool according to claim 3, wherein the transporting device displacing means comprises two locking members (31, 32) axially offset relative to each other and arranged on opposite sides of the guide channel (22).

8. A setting tool according to claim 7, comprising means for actuating both locking members (31, 31) one after another for effecting a complete transporting sequence for displacing a new propellant in a position coaxial with the propellant receptacle (18).

9. A setting tool according to claim 8, wherein actuation of both locking members one after another takes place for effecting a complete transporting sequence for displacing a burnt-up propellant out of a position coaxial with the propellant receptacle (18).

10. A setting tool according to claim 7, wherein the two locking members (31, 32) are formed as pawls pivotally supported on respective pivot supports (35, 36).

11. A setting tool according to claim 10, wherein the pivot supports (35, 36) are secured on a guide housing (28) for the ignition means (23).

* * * * *